US009601260B2

(12) United States Patent
Larsson

(10) Patent No.: US 9,601,260 B2
(45) Date of Patent: Mar. 21, 2017

(54) METHOD OF MANUFACTURING AN ELECTROMAGNETIC INDUCTION DEVICE AND AN ELECTROMAGNETIC INDUCTION DEVICE

(71) Applicant: ABB Schweiz AG, Baden (CH)

(72) Inventor: Tommy Larsson, Ludvika (SE)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 14/908,437

(22) PCT Filed: Apr. 24, 2014

(86) PCT No.: PCT/EP2014/058294

§ 371 (c)(1),
(2) Date: Jan. 28, 2016

(87) PCT Pub. No.: WO2015/022089

PCT Pub. Date: Feb. 19, 2015

(65) Prior Publication Data

US 2016/0189859 A1 Jun. 30, 2016

(30) Foreign Application Priority Data

Aug. 12, 2013 (EP) ..... 13180142

(51) Int. Cl.
*H01F 29/04* (2006.01)
*H01F 27/02* (2006.01)
*H01F 41/02* (2006.01)

(52) U.S. Cl.
CPC ..... *H01F 29/04* (2013.01); *H01F 27/02* (2013.01); *H01F 41/02* (2013.01)

(58) Field of Classification Search
CPC ..... H01F 29/04; H01F 27/02; H01F 29/02; H01F 27/04; H01F 41/02
(Continued)

(56) References Cited

U.S. PATENT DOCUMENTS 1,736,459 A * 11/1929 Oplinger ..... H01H 9/0027 361/192
1,818,686 A * 8/1931 Burnham ..... H01F 29/04 361/603
(Continued)

FOREIGN PATENT DOCUMENTS

CN 2681308 Y 2/2005
CN 102623155 A 8/2012
(Continued)

OTHER PUBLICATIONS

European Search Report Application No. 13180142.5 Completed: Jan. 22, 2014;Mailing Date: Feb. 3, 2014 4 pages.
(Continued)

*Primary Examiner* — Mangtin Lian
*Assistant Examiner* — Malcolm Barnes
(74) *Attorney, Agent, or Firm* — Whitmyer IP Group LLC

(57) ABSTRACT

A method of manufacturing an electromagnetic induction device with On-Load Tap Changer. The method includes: a) providing an electromagnetic core with windings, b) suspending an OLTC insulation barrier from the electromagnetic induction device by a suspension, wherein the OLTC interface barrier arrangement is arranged to act as a barrier between an electromagnetic core housing and an OLTC, and wherein the OLTC interface barrier arrangement is provided with a first set of electrical connections arranged to be connected to the windings and a second set of electrical connections arranged to be connected to the OLTC, c) connecting the first set of electrical connections to the windings, and d) subjecting the windings and the OLTC interface barrier arrangement to a drying process.

17 Claims, 5 Drawing Sheets

(58) Field of Classification Search
USPC ..... 336/90, 150; 29/602.1
See application file for complete search history.

(56) References Cited

U.S. PATENT DOCUMENTS

| | | | | | |
|---|---|---|---|---|---|
| 2,820,953 | A * | 1/1958 | Cuthbertson | H01H 9/0005 | 336/150 |
| 3,243,748 | A * | 3/1966 | Lehmann | H01F 27/40 | 336/92 |
| 4,234,864 | A * | 11/1980 | Johansson | H01F 29/025 | 336/90 |
| 2009/0211890 | A1* | 8/2009 | Xiao | H01H 9/0038 | 200/337 |
| 2010/0315190 | A1* | 12/2010 | Haj-Maharsi | H01F 27/40 | 336/192 |
| 2011/0227686 | A1* | 9/2011 | Scian | H01F 27/04 | 336/90 |
| 2012/0112730 | A1* | 5/2012 | Brueckl | H01F 27/40 | 323/343 |
| 2013/0033349 | A1* | 2/2013 | Takano | H01F 27/04 | 336/94 |
| 2015/0028978 | A1* | 1/2015 | Bieringer | H01F 29/04 | 336/150 |

FOREIGN PATENT DOCUMENTS

| | | | |
|---|---|---|---|
| EP | 2509089 | A1 | 10/2012 |
| GB | 480146 | A | 2/1938 |
| GB | 983282 | A | 2/1965 |
| JP | S62216308 | A | 9/1987 |
| JP | H0963867 | A | 3/1997 |

OTHER PUBLICATIONS

International Search Report and Written Opinion of the International Searching Authority Application No. PCT/EP2014/058294 Completed: May 16, 2014;Mailing Date: May 26, 2014 11 pages.

* cited by examiner

METHOD OF MANUFACTURING AN ELECTROMAGNETIC INDUCTION DEVICE AND AN ELECTROMAGNETIC INDUCTION DEVICE

FIELD OF THE INVENTION

The present disclosure generally relates to inductive devices and in particular to a method of manufacturing an electromagnetic induction device, and to an electromagnetic induction device.

BACKGROUND OF THE INVENTION

Electromagnetic induction devices such as power transformers and reactors may be provided with On-Load Tap Changers (OLTC) for enabling stepped voltage regulation of the electromagnetic induction device as a means for voltage compensation when the electromagnetic induction device is On-Load, i.e. connected to a transmission or distribution network.

An OLTC unit which comprises a tap changer mechanism can either be of in-tank type or on-tank type. If the OLTC unit is arranged inside the electromagnetic core housing, i.e. the transformer tank or reactor tank, it is of in-tank type. If the OLTC unit is mounted to the electromagnetic core housing, it is of on-tank type. For the latter type of OLTC unit, the tap changer mechanism is separated from the interior of the electromagnetic core housing by means of an insulation barrier. The insulation barrier comprises electrical connections and acts as an interface between windings inside the electromagnetic core housing and the tap changer mechanism in the OLTC unit. Moreover, the insulation barrier separates dielectric fluid in the electromagnetic core housing from dielectric fluid in the OLTC unit, preventing mixing of the dielectric fluids and thus reducing the risk of one dielectric fluid contaminating the other.

The tap changer mechanism in the OLTC unit and the electromagnetic induction device windings, i.e. the active parts of the electromagnetic induction device, are provided with electrical insulation. This electrical insulation form an electrical insulation system which increases the dielectric withstand strength of the electromagnetic induction device. Such an electrical insulation is typically made of cellulose-based material. The active parts are provided with the electrical insulation mainly by means of manual labour. When the electrical insulation has been assembled with the active parts, the entire assembly is subjected to a drying process to remove moisture to increase the dielectric withstand strength of the electrical insulation and thus increase the lifetime of the electromagnetic induction device. The drying process may involve subjecting the electrical insulation system to vacuum and heating, sometimes combined with vaporised kerosene. When the drying process has been finalised, the final assembly and sealing of the electromagnetic induction device is performed by means of manual labour.

SUMMARY OF THE INVENTION

Since the final assembly is performed manually, it is a time-consuming process. Final assembly of the electromagnetic induction device includes manually connecting the OLTC interface barrier arrangement to the windings and to the tap changer mechanism and involves spending time in a hot and dry atmosphere of the drying process environment, or assembling kerosene vapour-soaked electrical insulation parts. Those performing the final assembly are hence subjected to hazardous working conditions for an extended amount of time. Moreover, long assembly times may result in that moisture is absorbed by the cellulose-based electrical insulation system in the not yet sealed electromagnetic induction device.

In view of the above, an object of the present disclosure is to provide a method of manufacturing an electromagnetic induction device and an electromagnetic induction device which solves or at least mitigates the problems of the prior art.

Hence, according to a first aspect of the present disclosure there is provided a method of manufacturing an electromagnetic induction device with On-Load Tap Changer, OLTC, capabilities, wherein the method comprises:

a) providing an electromagnetic core with windings, b) suspending an OLTC interface barrier arrangement from the electromagnetic induction device by means of suspension means, wherein the OLTC interface barrier arrangement is arranged to act as a barrier between an electromagnetic core housing and an OLTC unit, and wherein the OLTC interface barrier arrangement is provided with a first set of electrical connections arranged to be connected to the windings and a second set of electrical connections arranged to be connected to the OLTC unit, c) connecting the first set of electrical connections to the windings, and d) subjecting the windings and the OLTC interface barrier arrangement to a drying process.

By connecting the first set of electrical connections of the OLTC interface barrier arrangement prior to the drying process, less manual labour during final assembly of the electromagnetic induction device has to be performed. The amount of time spent on final assembly may therefore be shortened, and assembly workers will be subjected to hazardous working conditions to a lesser degree. Moreover, since the amount spent on final assembly is shortened, the electromagnetic induction device may be sealed a shorter amount of time after the drying process has ended. The risk of moist absorption post-drying is therefore reduced.

By suspending the OLTC interface barrier arrangement when the OLTC interface barrier arrangement is subjected to the drying process, the entire OLTC interface barrier arrangement may properly be subjected to the drying process. Generally, the OLTC interface barrier could be suspended from any fixed structure of the electromagnetic induction device participating in the drying process.

One embodiment comprises e) manoeuvring the suspension means such that the OLTC interface barrier arrangement is moved to the electromagnetic core housing.

One embodiment comprises fixating f) the OLTC interface barrier arrangement to the electromagnetic core housing.

One embodiment comprises sealing g) the OLTC interface barrier arrangement to the electromagnetic core housing.

One embodiment comprises connecting h) the second set of electrical connections to the OLTC unit.

One embodiment comprises mounting and sealing i) the OLTC unit to the electromagnetic core housing.

According to one embodiment in step b) the OLTC interface barrier arrangement is suspended from an upper yoke of the electromagnetic induction device.

According to one embodiment in step b) the OLTC interface barrier arrangement is suspended from an electromagnetic core housing lid mounted to the electromagnetic core.

The drying process including the suspended OLTC interface barrier arrangement may be carried out without the electromagnetic core housing by suspending the OLTC interface barrier to any of the two fixed structures exemplified above, which fixed structures typically are included in the drying process.

According to one embodiment the OLTC interface barrier arrangement is suspended such that the OLTC interface barrier arrangement has a free end during step d).

According to one embodiment the OLTC interface barrier arrangement has a main extension along a direction defined from one electromagnetic core leg towards another electromagnetic core leg.

The method as claimed in any of the preceding claims, wherein the electromagnetic induction device is a high voltage power transformer or high voltage reactor.

According to a second aspect of the present disclosure there is provided an electromagnetic induction device having On-Load Tap Changer, OLTC, capabilities, wherein the electromagnetic induction device comprises: an electromagnetic core housing; an electromagnetic core; windings arranged around the electromagnetic core; suspension means; and an OLTC interface barrier arrangement arranged to act as a barrier between the electromagnetic core housing and an OLTC unit, which OLTC interface barrier arrangement is provided with a first set of electrical connections arranged to be connected to the windings and a second set of electrical connections arranged to be connected to the OLTC unit, wherein the suspension means is arranged to suspend the OLTC interface barrier arrangement from the electromagnetic induction device.

According to one embodiment the OLTC interface barrier arrangement is manoeuvrable towards the electromagnetic core housing by means of the suspension means.

According to one embodiment the OLTC interface barrier arrangement is suspended from an upper yoke of the electromagnetic core.

According to one embodiment the OLTC interface barrier arrangement is suspended from an electromagnetic core housing lid mounted to the electromagnetic core.

Generally, all terms used in the claims are to be interpreted according to their ordinary meaning in the technical field, unless explicitly defined otherwise herein. All references to "a/an/the element, apparatus, component, means, etc. are to be interpreted openly as referring to at least one instance of the element, apparatus, component, means, etc., unless explicitly stated otherwise. Moreover, any step in a method need not necessarily have to be carried out in the presented order, unless explicitly stated otherwise.

BRIEF DESCRIPTION OF THE DRAWINGS

The specific embodiments of the inventive concept will now be described, by way of example, with reference to the accompanying drawings, in which.

DETAILED DESCRIPTION OF THE INVENTION

The inventive concept will now be described more fully hereinafter with reference to the accompanying drawings, in which exemplifying embodiments are shown. The inventive concept may, however, be embodied in many different forms and should not be construed as limited to the embodiments set forth herein; rather, these embodiments are provided by way of example so that this disclosure will be thorough and complete, and will fully convey the scope of the inventive concept to those skilled in the art. Like numbers refer to like elements throughout the description.

Figure 1:
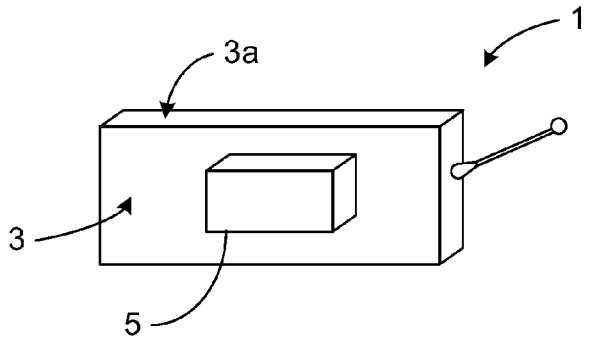
FIG. 1 schematically shows a perspective view of an electromagnetic induction device.

FIG. 1 shows an example of an electromagnetic induction device 1 with OLTC capabilities in an assembled state. The electromagnetic induction device 1 has an electromagnetic core housing or electromagnetic induction device tank 3. The electromagnetic core housing 3 has an electromagnetic core housing lid 3*a*, sometimes referred to as an electromagnetic core housing cover. The electromagnetic core housing 3 houses an electromagnetic core and windings provided around the one or more legs of the electromagnetic core. The electromagnetic core housing lid 3*a* is typically mounted to the upper portion of the electromagnetic core. The electromagnetic core housing 3 is filled with a dielectric fluid, such as transformer oil, SF6, or an ester.

In the fully assembled state, the electromagnetic induction device 1 comprises an OLTC unit 5. The OLTC unit 5 is of on-tank type and is mounted to the electromagnetic core housing 3. The OLTC unit 5 comprises a tap changer mechanism which is electrically connectable to the windings of the electromagnetic core housing 3 via an OLTC interface barrier arrangement. The OLTC unit 5 is filled with a dielectric fluid, such as transformer oil, SF6, or an ester.

Figure 2A:
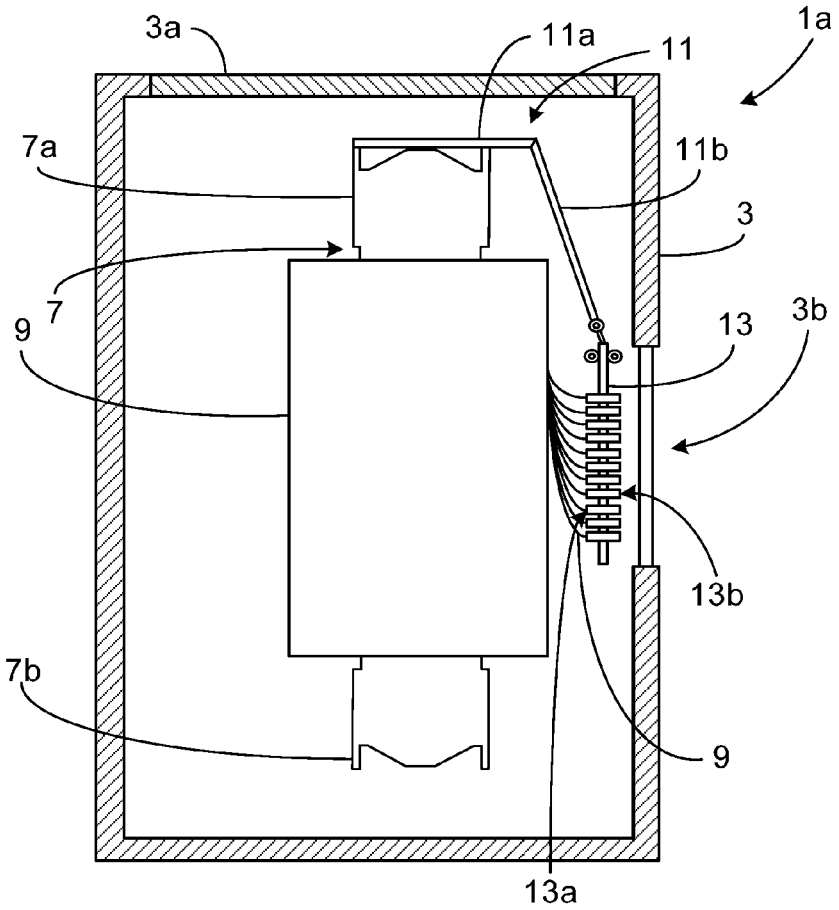
FIG. 2*a* schematically shows a vertical section of an electromagnetic induction device with an OLTC interface barrier arrangement suspended from the electromagnetic induction device.

FIG. 2*a* schematically shows a vertical section of an electromagnetic induction device la similar to the one illustrated in FIG. 1, with the OLTC unit 5 not yet mounted to the electromagnetic core housing 3. The electromagnetic core housing 3 houses an electromagnetic core 7, for example a laminated steel core. The electromagnetic induction device 1, and in particular the electromagnetic core 7 has an upper yoke 7*a* and a lower yoke 7*b*. With the term "upper" is meant an orientation of the electromagnetic core 7 when the electromagnetic induction device is placed on ground as intended when properly installed on-site.

The electromagnetic induction device la comprises a suspension means 11 and an OLTC interface barrier arrangement 13. The suspension means is arranged to suspend the OLTC interface barrier arrangement 13 from the electromagnetic induction device 1*a*. The OLTC interface barrier arrangement 13 is preferably suspended in such a manner that its main surface, i.e. largest surface, is parallel with a vertical plane. The OLTC interface barrier arrangement 13 is hence parallel with or essentially parallel with the electromagnetic core housing 3 when the OLTC interface barrier arrangement 13 is arranged inside the electromagnetic core housing 3.

According to the example in FIG. 2*a*, the suspension means are arranged to suspend the OLTC interface barrier arrangement 13 from the upper yoke 7*a*. The OLTC interface barrier arrangement could however be suspended from other fixed structures of the electromagnetic induction device. The OLTC interface barrier arrangement could for example be suspended from the electromagnetic core housing lid 3*a*, as shown in FIG. 2*d*. Although not specifically shown in the schematic drawing of FIGS. 2*a*-d, the electromagnetic core housing lid 3*a* is typically mounted to the electromagnetic core 7, in particular the upper yoke 7*a*, prior to arrangement of the electromagnetic core in the electromagnetic core housing 3. The electromagnetic housing lid 3*a* is typically included in the drying process and is therefore a suitable alternative fixed structure for suspending the OLTC interface barrier during the drying process. Alternatively, the suspension means could for example be attached to the interior side wall or interior upper wall of the electromagnetic core housing if the entire electromagnetic core housing 3 is included in the drying process. This is however typically not the case when dealing with large electromagnetic induction devices, for example for high voltage applications.

The electromagnetic core 7 is provided with windings 9. The windings 9 are arranged around the electromagnetic core 7 and its turns extend between the upper yoke 7*a* and the lower yoke 7*b*.

The OLTC interface barrier arrangement 13 comprises a first set of electrical connections 13*a* arranged to be connected to the windings 9, in particular to regulatory windings. The OLTC interface barrier arrangement 13 comprises a second set of electrical connections 13*b* arranged to be connected to an OLTC unit, such as OLTC unit 5. The first set of electrical connections 13a and the second set of electrical connections 13b are electrically conducting. The first set of electrical connections 13*a* is in electrical connection with the second set of electrical connections 13*b*. The first set of electrical connections 13*a* and the second set of electrical connections 13*b* may be the same set of connections penetrating the OLTC interface barrier arrangement. Current is by means of the first set of electrical connections 13*a* and the second set of electrical connections 13*b* able to flow between the windings 9 and the tap changer mechanism of an OLTC unit connected to the OLTC interface barrier arrangement 13.

The OLTC interface barrier arrangement 13 is at least partly electrically insulating. The OLTC interface barrier arrangement 13 may for example comprise a cellulose-based material, epoxy or polyester. The connections of the first set of electrical connections 13*a* are electrically insulated from each other by means of electrically insulating portions of the OLTC interface barrier arrangement 13. The connections of the second set of electrical connections 13*b* are electrically insulated from each other by means of electrically insulating portions of the OLTC interface barrier arrangement 13.

The electromagnetic core housing 3 has an opening 3*b* which is aligned or essentially aligned with the OLTC interface barrier arrangement 13 when the OLTC interface barrier arrangement 13 is suspended by the suspending means 11. The length and width dimensions of the OLTC interface barrier arrangement 13 are greater than the corresponding dimensions of the opening 3*b*. The suspending means 11 advantageously has a mechanism which allows translational movement of the OLTC interface barrier arrangement 13 from its suspended position towards the electromagnetic core housing 3 for sealing the opening 3*b*. According to the example in FIG. 2*a*, the suspending means 11 has a first arm 11*a* which is fixedly arranged to the upper yoke 7*a*. The first arm 11*a* is electrically insulated from the windings 9. The suspending means 11 has a second arm 11*b* which is pivotally coupled to the first arm 11*a*. The second arm 11*b* is pivotally coupled to the OLTC interface barrier arrangement 13 at a proximal end of the OLTC interface barrier arrangement 13. The length of the first arm 11*a* is such that the pivotal coupling to the second arm 11*b* allows the second arm 11*b* to hang freely in a direction parallel to the axial direction of the electromagnetic core 7. The OLTC interface barrier arrangement 13 is thus suspended from the suspension means 11 and may have a free end, in particular a free distal end relative to the pivotal coupling with the second arm 11*b*. The length dimension of the second arm 11*b* is such that the proximal end of the OLTC interface barrier arrangement 13 is closer to the upper yoke 7*a* in axial distance than an upper end of the opening 3*b*. Moreover, the distal end of the OLTC interface barrier arrangement is closer to the lower yoke 7*b* in axial distance than a lower end of the opening 3*b*.

The second arm 11*b* may form a swing beam which allows the OLTC interface barrier arrangement 13 to be manoeuvred and swing from its suspended position towards the electromagnetic core housing 3. The OLTC interface barrier arrangement 13 may be provided with means for fixating the OLTC interface barrier arrangement 13 to the electromagnetic core housing 3 when the OLTC interface barrier arrangement 13 has been moved to the electromagnetic core housing 3. Other implementations of the suspending means are also envisaged, as would be apparent to the skilled person. Instead of pivotally coupling the first arm and the second arm, the length of the first arm could for example be extendable along an axis perpendicular to the axial direction of the electromagnetic core.

Figure 2B:
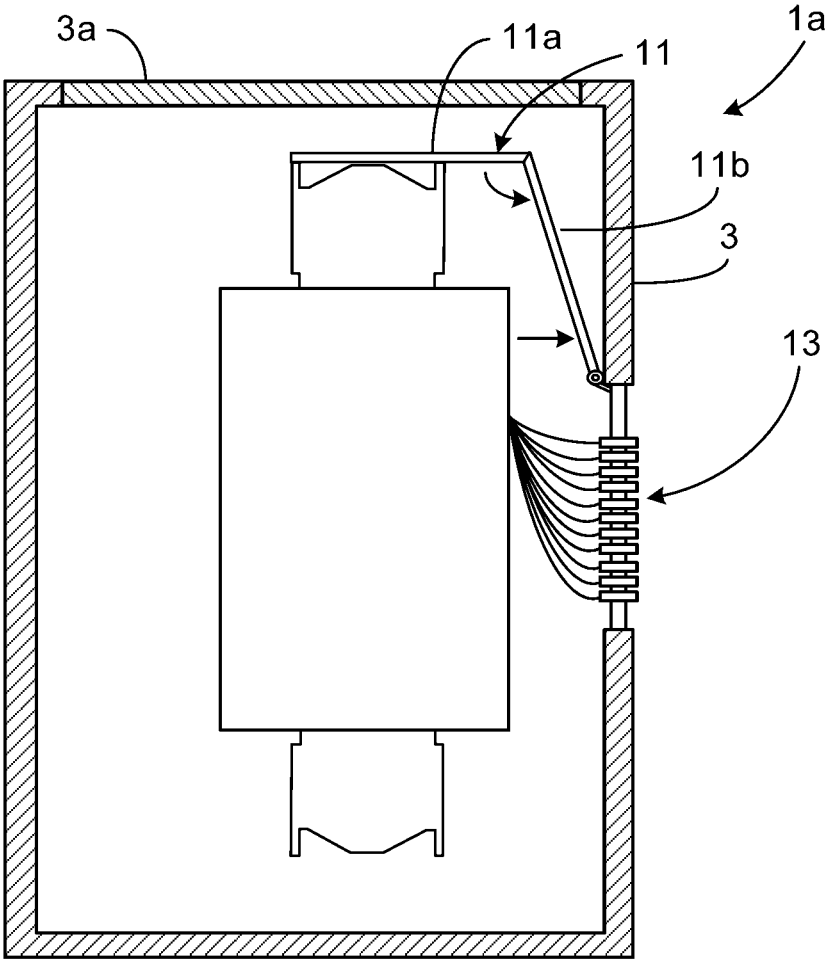
FIG. 2*b* schematically shows a vertical section of the electromagnetic induction device in FIG. 2*a* with the OLTC interface barrier arrangement attached to the electromagnetic core housing.

FIG. 2*b* illustrates the electromagnetic induction device la when the OLTC interface barrier arrangement 13 has been moved to the opening 3*b* of the electromagnetic core housing 3. The movement of the OLTC interface barrier arrangement 13 could be done manually by hand or by machine. When the OLTC interface barrier arrangement 13 has been arranged in position, the OLTC interface barrier arrangement 13 is fixed to the electromagnetic core housing 3. The OLTC interface barrier arrangement 13 is sealed to the electromagnetic core housing 3. The sealing of the OLTC interface barrier arrangement 13 with the electromagnetic core housing 3 is made by means of one or more seals such as an O-ring or by means of cork rubber and a screw joint.

Figure 2C:
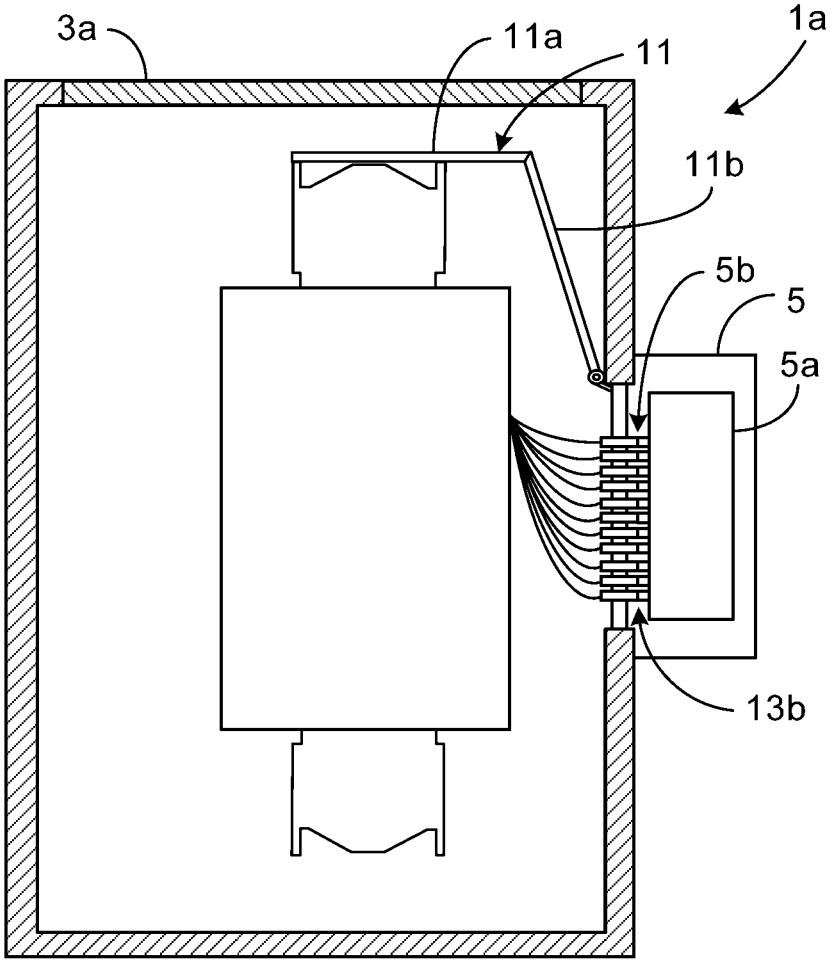
FIG. 2*c* schematically shows a vertical section of the electromagnetic induction device in FIG. 2*a* with an OLTC unit attached to the OLTC interface barrier arrangement.
Figure 2D:
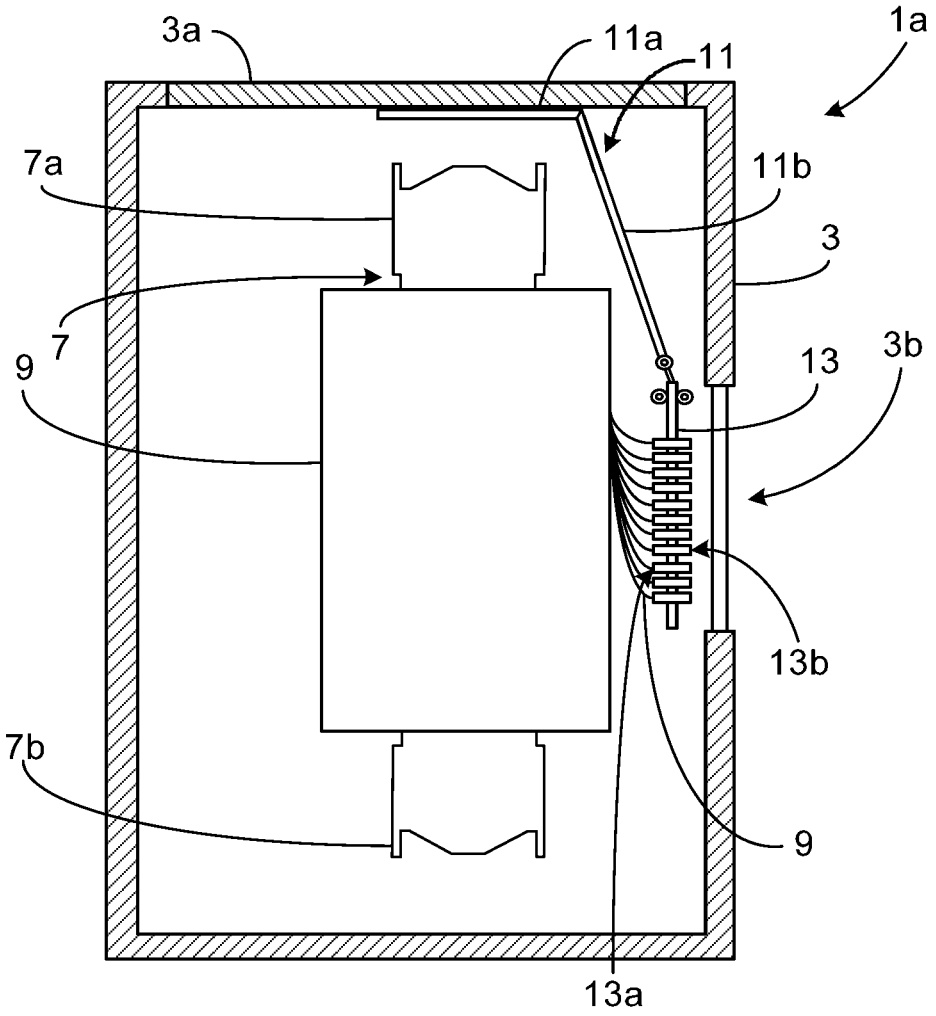
FIG. 2*d* schematically shows a vertical section of an electromagnetic induction device with an OLTC interface barrier arrangement suspended from an electromagnetic core housing lid of the electromagnetic induction device.

FIG. 2*c* illustrates the electromagnetic induction device 1*a* when OLTC unit 5 has been attached to the electromagnetic core housing 3. The OLTC unit 5 comprises a tap changer mechanism 5*a* and tap changer mechanism connections 5*b* arranged to be connected to the second set of electrical connections 13*b* of the OLTC interface barrier arrangement 13. The OLTC unit 5 may be attached to the electromagnetic core housing 3 prior to transportation to site, during transportation or on-site. The OLTC unit may be attached to the long side, short side or the top of the electromagnetic core housing. In FIG. 2*c*, the OLTC unit 5 is attached to the long side of the electromagnetic core housing 3.

An example of an OLTC unit which may be utilised is a rack-mounted OLTC such as the one described in U.S. provisional application No. 61/767,919 which discloses a tap changer comprising a tap changer tank and a phase-unit assembly. The tap changer tank includes sealed attachment means for mechanically attaching the tap changer tank onto a transformer tank. The phase-unit assembly comprises at least one phase unit having a set of fixed contacts. The tap changer further comprises a set of connectors arranged at an outer part of the phase-unit assembly, which connectors provide an electrical interface to a transformer. The fixed contacts are electrically connected to a respective one of the connectors, and the connectors are arranged as plug-in connectors. Prior to connecting the connectors to corresponding connectors of a transformer tank, the tap changer tank and the phase-unit assembly are mechanically separated. Furthermore, the tap-changer tank has an access opening and a guiding surface, which guiding surface is arranged to guide the phase-unit assembly from the access opening into the tap-changer tank along a mainly horizontal line. It is to be noted that although a rack-mounted OLTC unit as described above may advantageously be used with electromagnetic induction devices according to the present disclosure, essentially any OLTC unit of on-tank type, possibly with modifications, may be utilised.

Figure 3:
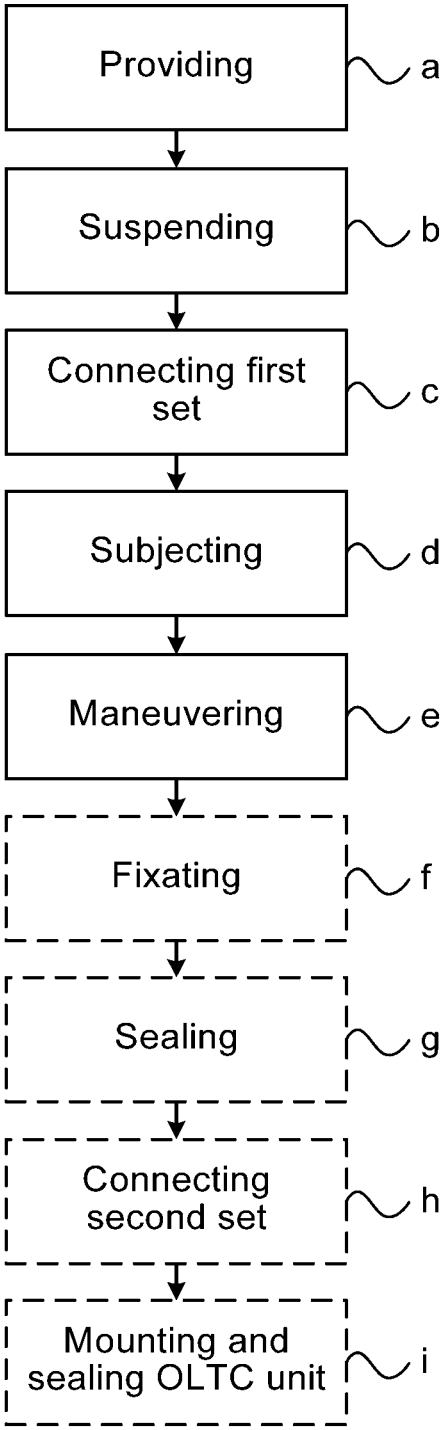
FIG. 3 illustrates a method of manufacturing an electromagnetic induction device.

A method of manufacturing an electromagnetic induction device such as electromagnetic induction device 1 and la will now be described with reference to FIG. 3. Prior to providing windings to the electromagnetic core, the electromagnetic core 7 is provided. For the purpose of the present manufacturing method, the electromagnetic core 7 may for example be pre-manufactured at another site or it may be assembled for example by stacking a plurality of steel laminations.

In a step a) the electromagnetic core 7 is provided with windings 9. Step a) is typically carried out by means of assembly personnel who wind the windings around the electromagnetic core 7 by means of manual labour.

In a step b) the OLTC interface barrier arrangement 13 is suspended from the electromagnetic induction device by means of suspension means 11. The suspension means 11 are typically mounted to the electromagnetic induction device after the windings 9 have been provided to the electromagnetic core 7. Step b) is also typically carried out after the windings 9 have been provided to the electromagnetic core 7, but could alternatively be provided prior to the windings are arranged around the electromagnetic core 7. According to one variation the OLTC interface barrier arrangement 13 is suspended from the upper yoke 7*a* of the electromagnetic induction device 1*a*. The OLTC interface barrier arrangement may alternatively be suspended from the electromagnetic core housing lid 3*a*, as previously discussed, or from any other suitable fixed structure of the electromagnetic induction device included in the drying process.

In a step c) the first set of electrical connections 13*a* are connected to the windings 9, in particular the regulating winding. The connection of the first set of electrical connections 13*a* is also typically carried out by means of manual labour.

In a step d) the windings 9 and the OLTC interface barrier arrangement 13 are subjected to a drying process. The drying process may involve subjecting the windings 9 and the OLTC interface barrier arrangement 13 to vacuum and heating sometimes combined with vaporised kerosene. When the drying process of step d) has been finalised, and thus the moisture level of the electrical insulation system of the electromagnetic induction device has been reduced, the electromagnetic core 7, with windings 9 and the suspended OLTC interface barrier 13 are arranged in the electromagnetic core housing 3, if these components were not already arranged in the electromagnetic core housing 3 during the drying process of step d). For large electromagnetic induction devices, the active parts mentioned above are typically installed in the electromagnetic core housing after the drying process.

After the drying process, and when the electromagnetic core 7, with windings 9, and the suspended OLTC interface barrier 13 have been installed or arranged in the electromagnetic core housing 3, the suspension means 11 is manoeuvred in a step e) such that the OLTC interface barrier arrangement 13 is moved to the electromagnetic core housing 3. In particular, the OLTC interface barrier arrangement 13 is moved to the opening 3*b* of the electromagnetic core housing 3.

In a step f) the OLTC interface barrier arrangement 13 is fixated to the electromagnetic core housing 3. In a step g) the OLTC interface barrier arrangement 13 is sealed to the electromagnetic core housing 3. The opening 3*b* is thereby sealed by means of the OLTC interface barrier arrangement 13.

In a step h) the second set of electrical connections 13*b* are connected to the OLTC unit 5. In particular, the second set of electrical connections 13*b* are connected to the tap changer mechanism connections 5*b*. Step h) may be carried out prior to transportation to site, during transportation to site or on-site.

In a step i) the OLTC unit 5 is mounted and sealed to the electromagnetic core housing 3. Step i) of mounting and sealing the OLTC unit 5 to the electromagnetic core housing 3 may be performed prior to or after step h) of connecting the second set of electrical connections 13*b*, or after step h).

The electromagnetic core housing 3 is typically filled with a dielectric fluid when the electromagnetic core housing 3 has been sealed. The OLTC unit 5 is also normally filled with a dielectric fluid when it has been sealed.

The electromagnetic induction devices 1 and 1*a* presented herein may be a power transformer or a reactor. The electromagnetic induction devices may be of high voltage type or medium voltage type and they may advantageously be used in power transmission networks or power distribution networks.

The inventive concept has mainly been described above with reference to a few examples. However, as is readily appreciated by a person skilled in the art, other embodiments than the ones disclosed above are equally possible within the scope of the inventive concept, as defined by the appended claims.

The invention claimed is:

1. A method of manufacturing an electromagnetic induction device with On-Load Tap Changer (OLTC) capabilities, wherein the method comprises:

a) providing an electromagnetic core with windings within an electromagnetic core housing, b) suspending an OLTC interface barrier from one of the electromagnetic core or the electromagnetic core housing by means of suspension means such that the OLTC interface barrier is movable, wherein the OLTC interface barrier is arranged to act as a barrier between an interior of the electromagnetic core housing and an OLTC unit, and wherein the OLTC interface barrier is provided with a first set of electrical connections arranged to be connected to the windings and a second set of electrical connections arranged to be connected to the OLTC unit, c) connecting the first set of electrical connections to the windings, and d) subjecting the windings and the OLTC interface barrier to a drying process.

2. The method as claimed in claim 1, including the steps of e) manoeuvring the suspension means such that the OLTC interface barrier is moved to the electromagnetic core housing.

3. The method as claimed in claim 2, including the steps of fixating the OLTC interface barrier to the electromagnetic core housing.

4. The method as claimed in claim 3, including the steps of sealing the OLTC interface barrier to the electromagnetic core housing.

5. The method as claimed in claim 3, including the steps of connecting the second set of electrical connections to the OLTC unit.

6. The method as claimed in claim 5, including the steps of mounting and sealing the OLTC unit to the electromagnetic core housing.

7. The method as claimed in claim 1, wherein in step b) the OLTC interface barrier is suspended from an upper yoke of the electromagnetic core.

8. The method as claimed in claim 1, wherein in step b) the OLTC interface barrier is suspended from an electromagnetic core housing lid mounted to the electromagnetic core housing.

9. The method as claimed in claim 1, wherein the OLTC interface barrier is suspended such that the OLTC interface barrier has a free end during step d).

10. The method as claimed in claim 1, wherein the OLTC interface barrier has a main extension along a direction defined from one electromagnetic core leg towards another electromagnetic core leg.

11. The method as claimed in claim 1, wherein the electromagnetic induction device is a high voltage power transformer or a high voltage reactor.

12. An electromagnetic induction device having On-Load Tap Changer (OLTC) capabilities, wherein the electromagnetic induction device comprises:

an electromagnetic core housing, an electromagnetic core within the electromagnetic core housing, windings arranged around the electromagnetic core, suspension means, and an OLTC interface barrier arranged to act as a barrier between an interior of the electromagnetic core housing and an OLTC unit, the OLTC interface barrier having a first set of electrical connections arranged to be connected to the windings and a second set of electrical connections arranged to be connected to the OLTC unit, wherein the suspension means is arranged to suspend the OLTC interface barrier from one of the electromagnetic core or the electromagnetic core housing such that the OLTC interface barrier is movable.

13. The electromagnetic induction device as claimed in claim 12, wherein the OLTC interface barrier is manoeuvrable towards the electromagnetic core housing by means of the suspension means.

14. The electromagnetic induction device as claimed in claim 12, wherein the OLTC interface barrier is suspended from an upper yoke of the electromagnetic core.

15. The electromagnetic induction device as claimed in claim 12, wherein the OLTC interface barrier is suspended from an electromagnetic core housing lid of the electromagnetic core housing.

16. The electromagnetic induction device as claimed in claim 13, wherein the OLTC interface barrier is suspended from an upper yoke of the electromagnetic core.

17. The electromagnetic induction device as claimed in claim 13, wherein the OLTC interface barrier is suspended from an electromagnetic core housing lid of the electromagnetic core housing.

* * * * *